US005581149A

United States Patent [19]

Seko et al.

[11] Patent Number: 5,581,149

[45] Date of Patent: Dec. 3, 1996

[54] DISPLAY TUBE FOR LIGHT SOURCE

[75] Inventors: Yukiharu Seko; Hiroshi Kamogawa; Sashiro Uemura; Mitsuaki Morikawa; Tokuhide Shimojo, all of Mie, Japan

[73] Assignee: ISE Electronics Corporation, Japan

[21] Appl. No.: 294,078

[22] Filed: Aug. 22, 1994

[30] Foreign Application Priority Data

May 30, 1994 [JP] Japan ..... 6-116592

[51] Int. Cl.[6] ..... H01J 29/86; H01J 19/54

[52] U.S. Cl. ..... 313/493; 313/495

[58] Field of Search ..... 313/494, 493, 313/495, 496; 428/690

[56] References Cited

U.S. PATENT DOCUMENTS

| | | | |
|---|---|---|---|
| 2,731,578 | 1/1956 | McCullough . | |
| 4,737,683 | 4/1988 | Shichao et al. | 313/495 |
| 5,057,739 | 10/1991 | Shimada et al. . | |
| 5,304,083 | 4/1994 | Uemura et al. . | |

FOREIGN PATENT DOCUMENTS

| | | | |
|---|---|---|---|
| 57-9053 | 1/1982 | Japan | 313/495 |
| 6-20656 | 1/1994 | Japan . | |

*Primary Examiner*—Sandra L. O'Shea
*Assistant Examiner*—Matthew J. Esserman
*Attorney, Agent, or Firm*—Samuels, Gauthier, Stevens & Reppert

[57] ABSTRACT

A display tube for a light source including a translucent face glass assembly having a front surface side which is formed spherically, a peripheral portion on which a step portion is formed, inner surface side on which a phosphor layer and a metallized film are sequentially formed, and a contact segment having one end connected to the metallized film. A glass bulb is provided having one open end portion sealed to the step portion of the translucent face glass assembly with low-melting frit glass. A stem assembly is provided having a anode electrode assembly and a cathode assembly mounted therein. The anode electrode assembly and the cathode assembly are accommodated in the glass bulb. The contact segment is contacted by the anode electrode assembly, the stem assembly being hermetically sealed at the other open end portion of the glass bulb. A high voltage applied to the anode assembly accommodated in the glass bulb is applied to the metallized film through the path of the contact segment.

2 Claims, 6 Drawing Sheets

DISPLAY TUBE FOR LIGHT SOURCE

BACKGROUND OF THE INVENTION

The present invention relates to a display tube for a light source that utilizes light emission of a phosphor and a method of manufacturing the same and, more particularly, to a display tube for a light source that constitutes pixels in, e.g., a color display unit having a large screen and a method of manufacturing the same.

FIGS. 6A and 6B explain the arrangement of a conventional fluorescent display tube for a light source, in which FIG. 6A shows this display tube as a whole, and FIG. 6B shows a portion B of FIG. 6A. Referring to FIGS. 6A and 6B, reference numeral 1 denotes a cylindrical glass bulb; and 2, a face glass sealed at one open end of the glass bulb 1 through a frit glass seal 3. The glass bulb 1, the face glass 2, and the frit glass seal 3 constitute a cylindrical glass bulb assembly 4 having one sealed end. Reference numeral 5 denotes a phosphor screen adhered on the rear side of the face glass 2; 6, an Al metallized film formed on the phosphor screen 5; 7, an anode formed on the inner wall surface of the glass bulb 1 on the face glass 2 side and made of a carbon film; and 8, a Ba gettered film formed between the Al metallized film 6 and the anode 7 for electrically connecting them.

A stem assembly 20 is bonded to the other open end of the glass bulb assembly 4. A stem glass 21 is sealed at the other open end of the glass bulb 1 through a frit glass seal 22. An exhaust pipe 23 is integrally formed with the stem glass 21. A cylindrical anode electrode 24 is fixed to the distal end portion of an anode lead 26 connected to a lead pin 25*a* extending through the stem glass 21. A bulb spacer contact 27 is mounted and fixed to the distal end portion of the anode electrode 24 and is brought into contact with the anode 7 to be electrically connected to it. A Ba getter 28 is mounted and fixed to the distal end portion of the bulb spacer contact 27. A cathode assembly 29 is fixed to the distal end portions of cathode leads 30 connected to lead pins 25*b* extending through the stem glass 21. In the cathode assembly 29, a back plate 32 and a filament cathode 33 are mounted on a ceramic plate 31. The back plate 32, the filament cathode 33, and the ceramic plate 31 are surrounded by a grid housing 34 having a mesh portion 34*a* at its central portion, thereby forming the cathode assembly 29.

In the display tube for a light source having the above arrangement, a high voltage applied from an external circuit to the lead pin 25*a* flows along a path of the anode lead 26→the anode electrode 24→the bulb spacer contact 27→the anode 7→the Ba gettered film 8 and is applied to the Al metallized film 6. Electron beams emitted from the cathode assembly 29 upon application of the voltage from the external circuit to the lead pins 25*b* are radiated to the phosphor screen 5 to excite it. Emission colors corresponding to the phosphors are displayed on the front surface side through the face glass 2.

However, the display tube for a light source having the above arrangement has problems as follows.

(1) Since the frit glass seal 3 is used to bond the face glass 2 and the glass bulb 1, the adhesion area is only the end portions of the glass members, thus decreasing the adhesion strength. In a heat test, the glass plate tends to be separated from this portion.

(2) The Al metallized film 6 adhered on the rear surface side of the phosphor screen 5 formed on the face glass 2 and the carbon anode 7 formed on the inner surface of the glass bulb 1 are brought into contact with each other through the Ba gettered film 8. The conductivity of the Ba gettered film 8 largely changes due to the gas emission amount in the pipe and the film quality (the film thickness and the gas adsorbing state). As the time passes in use, defective conduction caused by an increased resistance tends to occur, resulting in poor reliability in electrical connection.

(3) A carbon printed layer (coating layer) exists as the anode 7 on the inner surface of the glass bulb 1. Sometimes the carbon printed layer emits gas or the carbon powder falls to interfere with application of a high voltage.

(4) Since the frit glass seal 22 identical to that used in the above item (1) is used to bond the glass bulb 1 and the stem assembly 20, the adhesion strength is insufficient and heat resistance is low. Abnormal electric discharge sometimes occurs at the high-voltage applying pin portion, resulting in poor reliability.

(5) Since the front surface side of the face glass 2 is formed flat, emitted light does not spread largely, thereby greatly limiting the angle of visual field.

SUMMARY OF THE INVENTION

The present invention has been made to solve the conventional problems described above, and has as its object to provide a display tube for a light source, in which a high bonding strength between a face glass and a glass bulb is maintained over a long period of time to improve the quality and reliability, and a method of manufacturing the same.

It is another object of the present invention to provide a display tube for a light source, in which electrical connection between a metallized film and an anode electrode is stabilized over a long period of time to improve the quality and reliability, and a method of manufacturing the same.

It is still another object of the present invention to provide a method of manufacturing a display tube for a light source, in which the bonding strength between a glass bulb and a stem assembly is increased to reliably prevent separation and cracking in a heat test, thereby improving the reliability.

In order to achieve the above objects, according to an aspect of the present invention, there is provided a display tube for a light source, comprising a translucent face glass assembly having a front surface side which is formed spherically, a peripheral portion on which a stepped portion is formed, an inner surface side on which a phosphor layer and a metallized film are sequentially formed, and a contact segment having one end electrically connected to the metallized film, a glass bulb having one open end portion sealed to the stepped portion of the translucent face glass assembly with low-melting frit glass, and a stem assembly having an anode electrode assembly and a cathode assembly the anode electrode assembly and the cathode assembly being accommodated in the glass bulb, and the contact segment being contacted by the anode electrode assembly, the stem assembly being hermetically sealed at the other open end portion of the glass bulb.

In the display tube for a light source according to the present invention, a high voltage applied to the anode assembly accommodated in the glass bulb is applied to the metallized film through the path of the contact segment.

DESCRIPTION OF THE PREFERRED EMBODIMENTS

The preferred embodiments of the present invention will be described in detail with reference to the accompanying drawings.

Figure 1A:
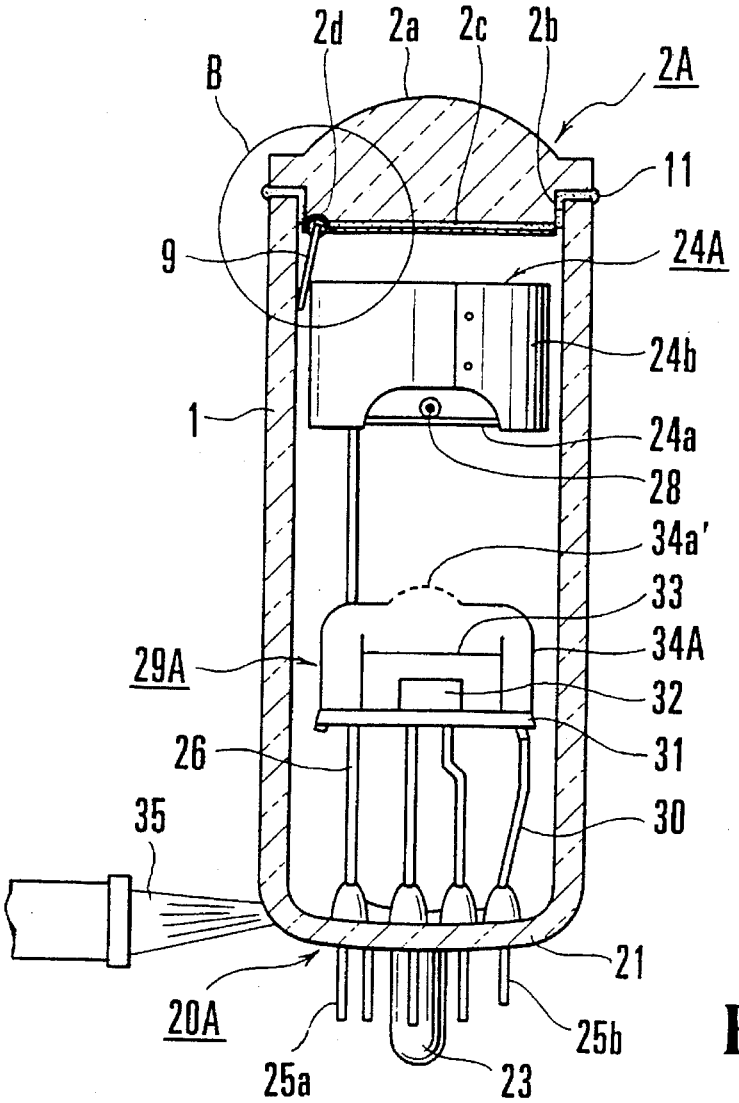
FIG. 1A is a sectional view showing the arrangement of a display tube for a light source according to an embodiment of the present invention.
Figure 1B:
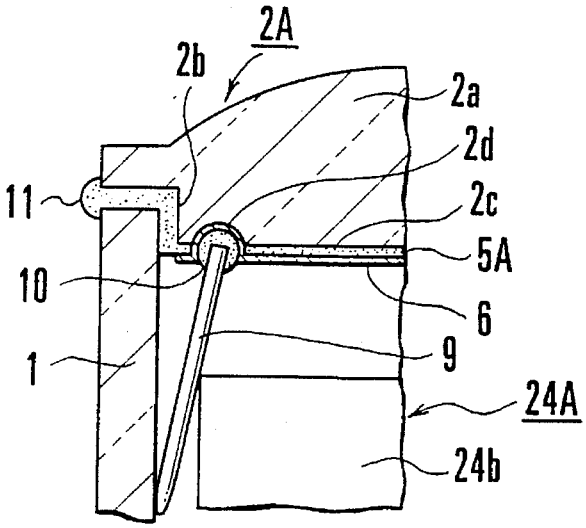
FIG. 1B is an enlarged sectional view of a portion B of FIG. 1A.
Figure 6A:
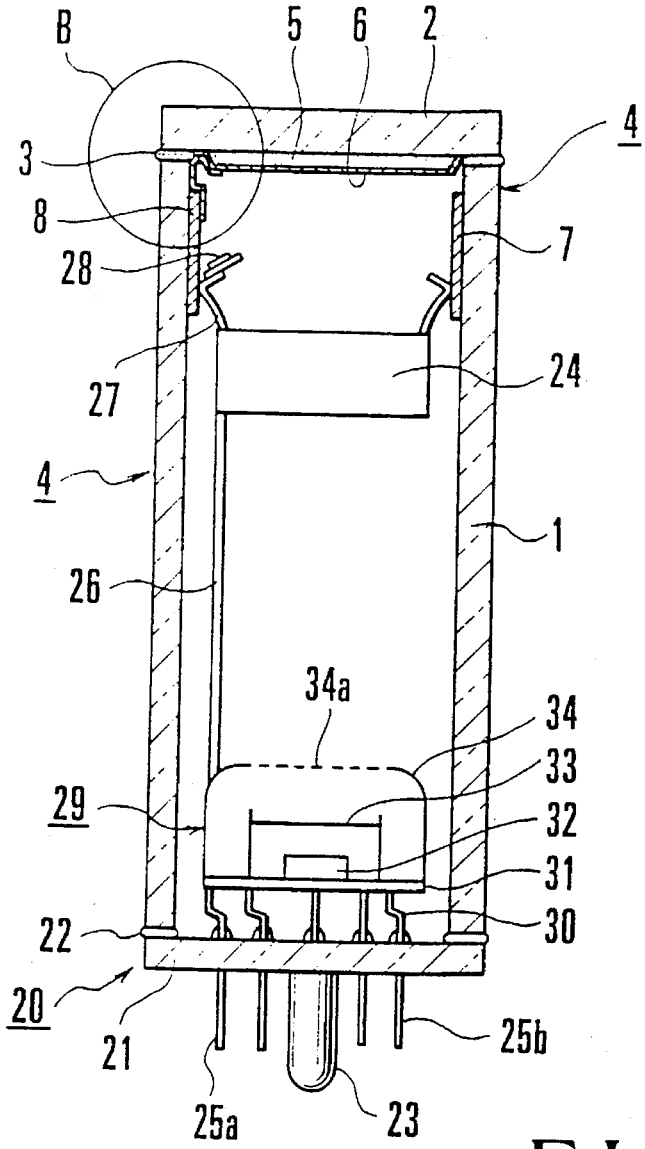
FIG.6A PRIOR ART
FIG. 6A is a sectional view showing the arrangement of a conventional display tube for a light source.
Figure 6B:
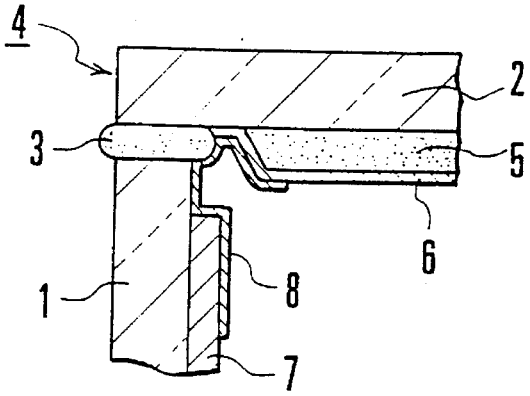
FIG.6B PRIOR ART
FIG. 6B is an enlarged sectional view of a portion B of FIG. 6A.

FIGS. 1A and 1B explain the arrangement of a display tube for a light source according to an embodiment of the present invention, in which FIG. 1A shows the display tube as a whole, and FIG. 1B shows a portion B of FIG. 1A. The same portions as in FIGS. 6A and 6B are denoted by the same reference numerals. Referring to FIGS. 1A and 1B, a spherical portion 2*a* having the shape of a convex lens is formed on the front surface side of a translucent face glass 2A. A stepped portion 2*b* is formed at the peripheral portion of the face glass 2A in the form of a collar. A depressed recessed portion 2*d* is formed at part of the peripheral portion of an inner surface 2*c* of the face glass 2A. A phosphor screen 5A and an Al metallized film 6 are sequentially formed on the major surface of the inner surface 2*c*. In this case, a phosphor screen 5A is not formed in the recessed portion 2*d* formed in the inner surface 2*c*, and only the Al metallized film 6 is formed at this portion.

One end side of an elastic contact segment 9 which is obtained by forming, e.g., a stainless steel thin plate by press molding, is inserted in the recessed portion 2*d* formed in the inner surface 2*c* of the face glass 2A, and is fixed to it by adhesion by using a conductive adhering material 10 comprising a mixture of, e.g., carbon or silver and frit glass. The other end side of the contact segment 9 extends toward the inner wall surface of a glass bulb 1. To form the phosphor screen 5A on the inner surface 2*c* of the face glass 2A, a solution obtained by dissolving a $Y_2O_2S$: Tb+$Y_2O_3$: Eu phosphor mixture as a white phosphor in a solvent is coated on the inner surface 2*c* of the face glass 2A having a predetermined shape to a thickness of about 20 μm by printing, and is dried.

Al is deposited on the phosphor screen 5 to form the Al metallized film 6 having a thickness of about 1,500 Å. In this case, the phosphor screen 5A is not formed on the recessed portion 2*d* formed in the inner surface 2*c* of the face glass 2A, and only the Al metallized film 6 is formed simultaneously at this portion. If the thickness of the Al metallized film 6 is excessively small, pin holes are increased to decrease reflection of the phosphor screen 5A; if it is excessively large, radiation of the electron beams to the phosphor screen 5A is interfered to decrease light emission. Thickness control is important. The Al metallized film 6 is set to have a thickness of about 1,500 Å for this reason. The face glass 2A on which the phosphor screen 5A and the Al metallized film 6 are formed is inserted in an electric furnace and burned in air at about 560° C. for about 30 minutes, thereby scattering the solvent and the like.

The glass bulb 1 having a diameter of about 20 mm and a length of about 50 mm, the two ends of which are cut, is prepared. A low-melting frit glass paste 11 is coated on one open end of the glass bulb 1 and the collar-shaped stepped portion 2*b* formed at the peripheral portion of the face glass 2A, and the glass bulb 1 is calcined.

Figure 2:
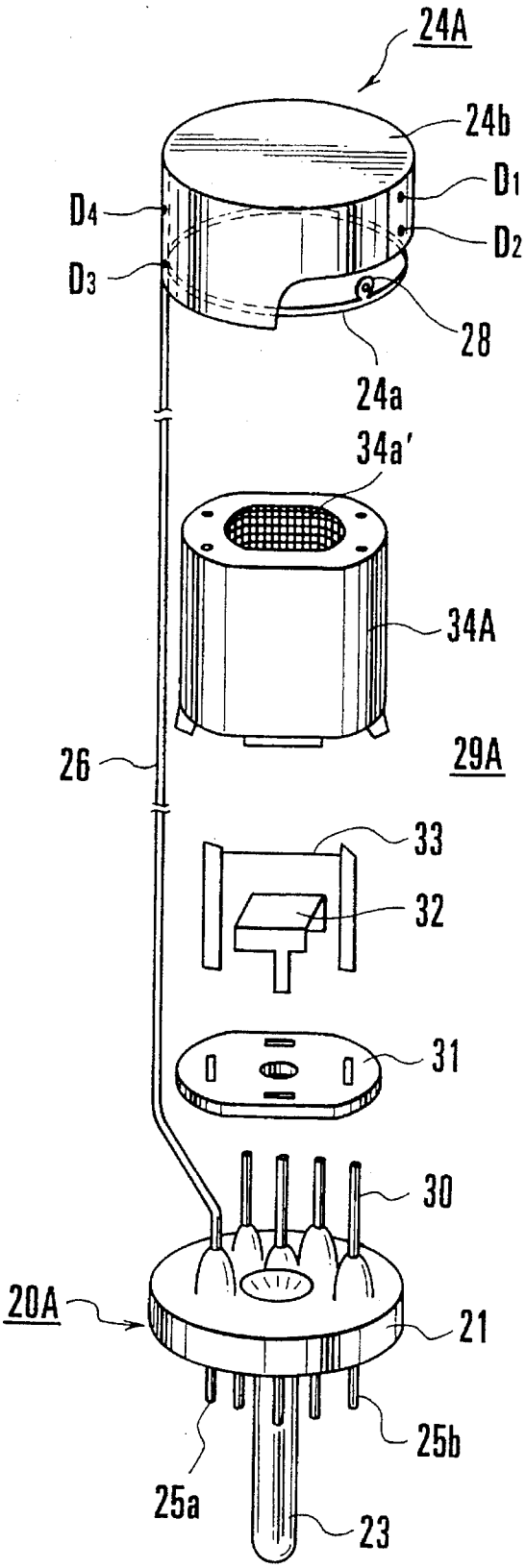
FIG. 2 is an exploded perspective view showing the arrangement of the stem assembly of the display tube for a light source according to the present invention.

As shown in FIG. 2, lead pins 25*a* and 25*b* extend through a stem glass 21, and an exhaust pipe 23 is integrally formed with the stem glass 21. An anode lead 26 is fixed to the distal end portion of the lead pin 25*a* by welding. A cylindrical anode electrode assembly 24A is mounted to the distal end portion of the anode lead 26 and fixed by welding.

The anode electrode assembly 24A is constituted by an annular anode 24*a* formed by coiling, e.g., a stainless steel metal wire (with a diameter of about 0.5 mm), and a cylindrical anode 24*b* formed cylindrically by applying a rectangular thin stainless steel plate (with a thickness of 0.01 to 0.02 mm) on the outer circumferential surface of the annular anode 24*a* and fixing overlapping portions at points $D_1$ and $D_2$ by, e.g., welding. The anode electrode assembly 24A is welded at a point $D_3$ to the distal end portion of the anode lead 26 by welding, and fixed, by welding, at a contact portion with the inner side of the cylindrical anode 24*b* at a point $D_4$ corresponding to the most distal end portion of the anode lead 26. More specifically, when the anode electrode assembly 24A is to be manufactured, the anode lead 26 and the annular anode 24*a* are integrally formed by welding at the point $D_3$. The cylindrical anode 24*b* is wound on the circumferential surface of the annular anode 24*a* and welded to it at the points $D_1$ and $D_2$, thus forming a cylindrical shape. Then, the obtained structure is welded to the anode lead 26 at the point $D_4$, thereby integrally forming the three components. A Ba getter 28 is mounted on and fixed to part of the annular anode 24*a* by, e.g., welding.

As shown in FIG. 2, on the stem glass 21 through which the lead pins 25*a* and 25*b* extend and which is integrally formed with the exhaust pipe 23, cathode leads 30 are fixed to the distal end portions of the lead pins 25*b* by welding, and a cathode assembly 29A is mounted on and fixed to the distal end portions of the cathode leads 30 by welding.

As shown in FIG. 2, in the cathode assembly 29A, a back plate 32 and a filament cathode 33 are mounted on a ceramic plate 31, and the back plate 32, the filament cathode 33, and the ceramic plate 31 are surrounded by an elliptic grid housing 34A having a mesh portion 34*a*' at its central portion which spherically projects toward a phosphor screen 5. The grid housing 34A is formed by forming a stainless steel plate having a thickness of about 100 μm by press molding. The mesh portion 34*a*' is formed to have, e.g., a longitudinal size of about 6 mm, a lateral size of about 4 mm, and a height of about 1.25 mm. In this manner, the anode electrode assembly 24A, the cathode assembly 29A, and the like are arranged on the lead pins 25*a* and 25*b*, extending through the stem glass 21 integrally formed with the exhaust pipe 23, with a predetermined gap therebetween, and mounted on the lead pins 25*a* and 25*b* by fixing, thereby constituting a stem assembly 20A.

After the stem assembly 20A is formed in this manner, the anode electrode assembly 24A and the cathode assembly 29A are inserted through the other open end of the glass bulb 1. The central axes of the anode electrode assembly 24A and the cathode assembly 29A are aligned and the open end of the glass bulb 1 and the peripheral portion of the stem glass 21 are assembled to be brought into contact with each other. The contact portion is heated and melted with a burner flame 35 obtained by burning a gas mixture of oxygen and propane gas, thereby bonding and sealing the open end of the glass bulb 1 and the peripheral portion of the stem glass 21. In this case, when sealing is to be performed by using a burner, an inert gas, e.g., $N_2$ or Ar gas, must be flowed into the glass bulb 1 to prevent oxidation of the cathode assembly 29A at a high temperature. The bulb sealed by the burner flame 35 is annealed for about 10 minutes.

When the bulb is sealed by using the burner, the face glass 2A, on which the phosphor screen 5A, the Al metallized film 6, and the contact segment 9 are formed in accordance with the steps described above, is fitted in one open end of the glass bulb 1. In this case, as shown in FIG. 1, the distal end portion of the contact segment 9 formed to project downward from the inner surface 2*c* of the face glass 2A is fitted in a cylindrical gap defined by the inner wall surface of the glass bulb 1 and the outer surface of the cylindrical anode 24*b* of the anode electrode assembly 24A, thereby combining the face glass 2A and the glass bulb 1. The obtained structure is fixed in a metal jig (not shown) and heated in an inert gas atmosphere at about 480° C. for about 30 minutes, so that the frit glass paste 11 adhered to the stepped portion 2*b* of the face glass 2A and to one open end of the glass bulb 1 by calcination is melted, thereby bonding the face glass 2A and the glass bulb 1 by sealing.

Figure 3:
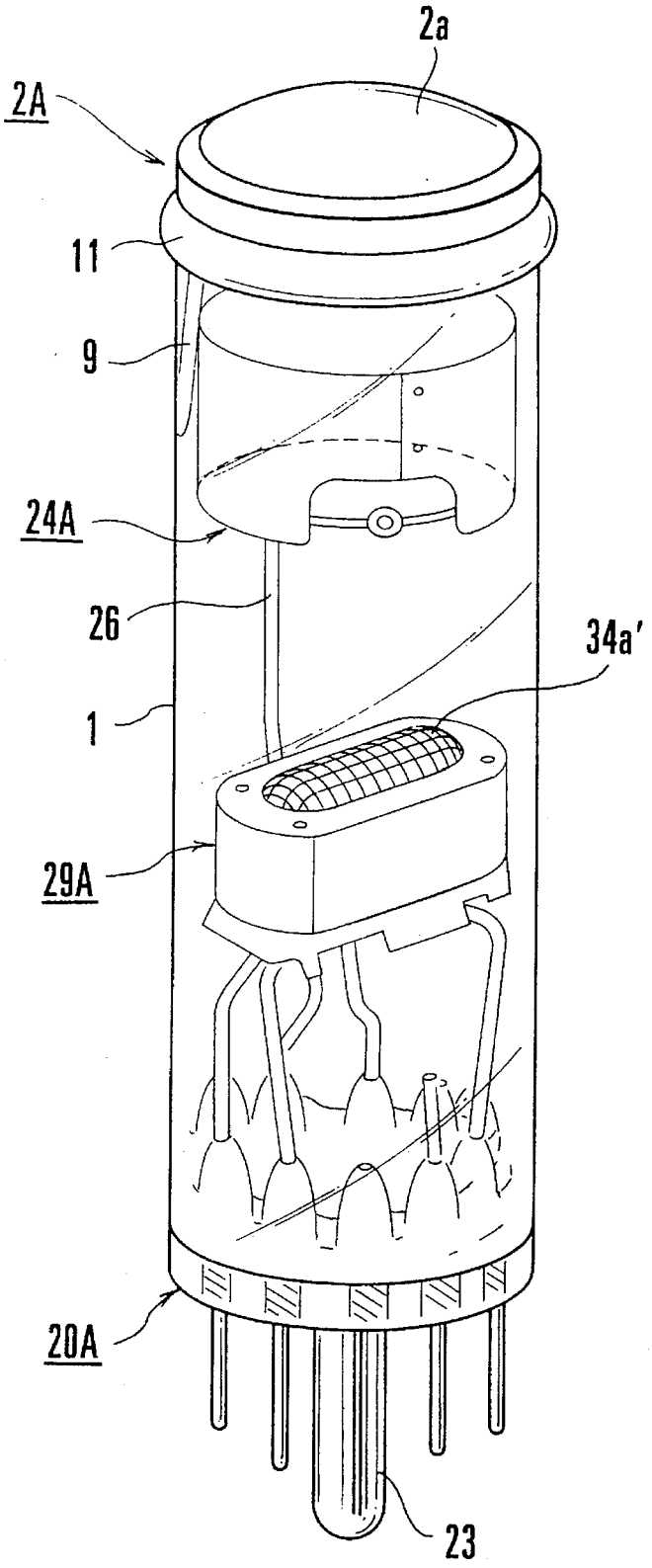
FIG. 3 is a perspective view showing the entire arrangement of the display tube for a light source according to the present invention.

A vacuum pump (not shown) is connected to the exhaust pipe 23 integrally formed with the stem assembly 20A, and air in the bulb is discharged. When a vacuum degree of about $10^{-6}$ Torr or less is achieved, the exhaust pipe 23 is separated at a predetermined portion by sealing with the gas burner, thereby completing a display tube for a light source as shown in FIG. 3.

In the display tube for a light source having the above arrangement, a high voltage externally applied to the lead pin 25*a* flows along a path of the anode lead 26→the anode electrode assembly 24A →the contact segment 9→the conductive adhering material 10 and is applied to the Al metallized film 6, thus contributing to light emission of the phosphor screen 5A.

With this arrangement, since the spherical portion 2*a* having the shape of the convex lens is formed on the front surface side of the face glass 2A, the angle of light emission from the phosphor screen 5A is increased to greatly increase the angle of visual field. Thus, the display surface can be visually recognized in a wide range.

With this arrangement, the stepped portion 2*b* is provided at the peripheral portion of the face glass 2A, inserted in one open end of the glass bulb 1, and sealed with the low-melting frit glass paste 11, so that the face glass 2A and the glass bulb 1 are bonded with each other at two surfaces. The adhesion area becomes about twice, and the adhesion strength is greatly increased. Therefore, the result of the heat test becomes very good, thereby reliably preventing cracking and separation.

With this arrangement, the recessed portion 2*d* is formed in the inner surface 2*c* of the face glass 2, the Al metallized film 6 is formed in the recessed portion 2*d* simultaneously, one end side of the contact segment 9 is fixed to the Al metallized film 6 in the recessed portion 2*d* with the conductive adhering material 10, and the other end side of the contact segment 9 is inserted in the gap between the outer surface of the cylindrical anode 24*b* of the anode electrode assembly 24A and the inner wall of the glass bulb 1 to make electrical contact. Thus, the contact segment 9 and the cylindrical anode 24*b* are mechanically brought into surface or linear contact, and the electrical contact between the Al metallized film 6 and the anode electrode assembly 24A becomes reliable. It is confirmed that even when a current of about 200 μA that sufficiently causes the phosphor screen 5A to emit light is flowed for a long period of time, no abnormality occurs at all.

With this arrangement, in the cathode assembly 29A, since the central portion of the grid housing 34A spherically projects toward the phosphor screen 5A to form the mesh portion 34*a*', the electron beams from the filament cathode 33 can be appropriately diffused. Thus, occurrence of emission spots on the phosphor screen 5A, defective light emission in which a dark portion is formed, and the like can be reliably prevented. Even if the grid housing 34A is slightly misaligned from the central axis of the glass bulb 1, bright spots are seldom formed. Thus, high-precision assembling operation becomes unnecessary, thereby greatly decreasing the number of operation steps.

With this manufacturing method, frit glass is not used to bond the glass bulb 1 and the stem glass 21 of the stem assembly 20A, and the glass members are sealed with each other in accordance with the melting scheme using a burner flame. Thus, the bonding strength can be greatly increased, and separation, cracking, and the like in the heat test can be reliably prevented. Since frit glass is not used in the vicinity of the high-voltage applying pins of the stem glass 21, even if a high voltage is applied, abnormal electric discharge does not occur, thereby greatly increasing reliability.

When the display tube for a light source fabricated in the above manner was turned on in accordance with the following conditions:

Cathode Voltage: Ef=0.45 V (AC)

Anode Voltage: Eb=10 kV (DC)

Back Plate Voltage: Ecy=0 V (DC)

Grid Voltage: Ecx=11 V (DC)

it exhibited a brightness of about 18,000 cd/$m^2$, thus providing brightness and stability that are sufficient for practical use.

Figure 4:
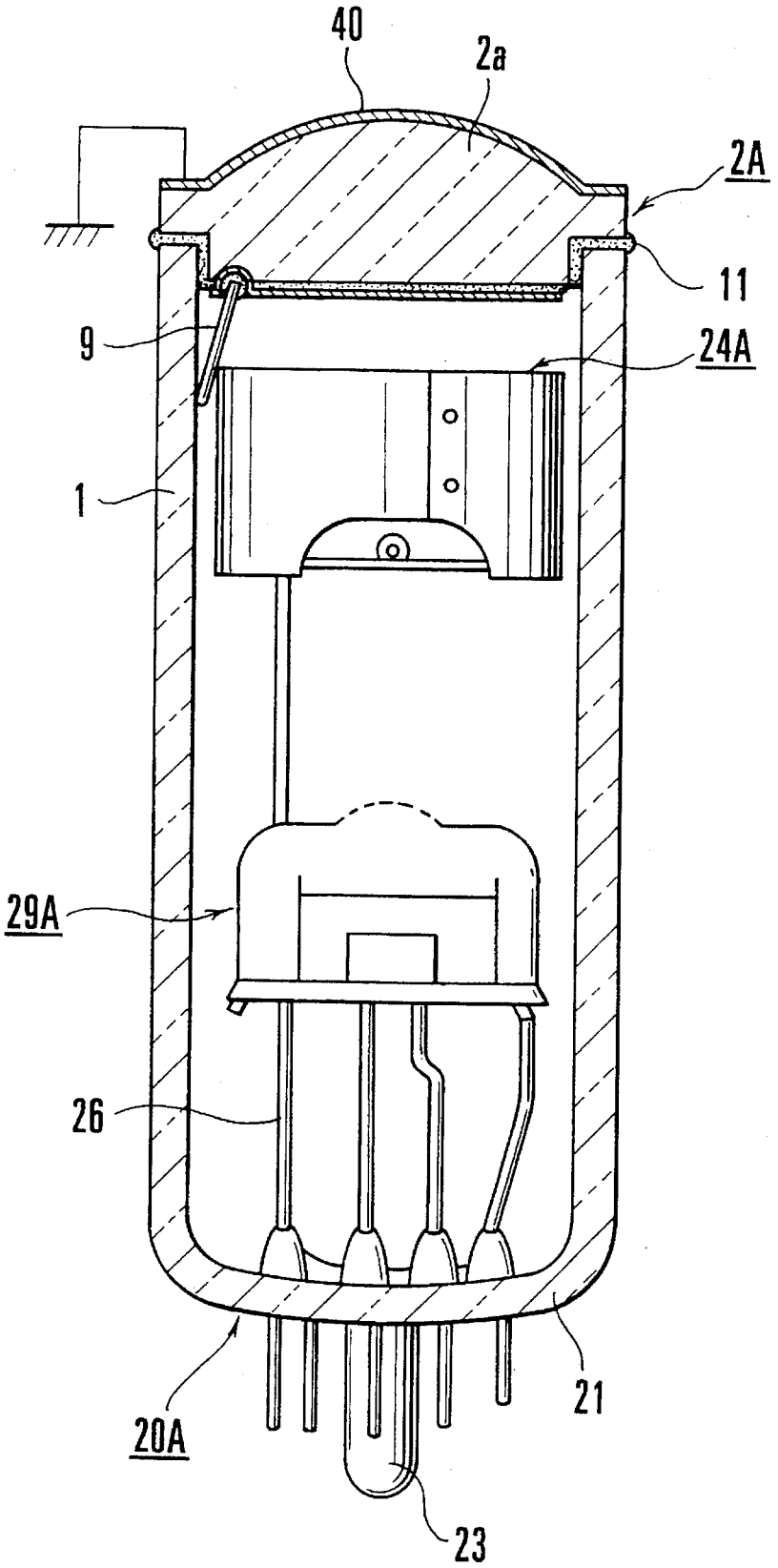
FIG. 4 is a sectional view of the main part of a fluorescent display tube according to another embodiment of the present invention.

The display tube for a light source having the above arrangement is caused to emit light by applying a high voltage. When attachment of dust on the outer surface of the spherical portion 2*a* at the front surface side of the face glass 2A caused by static electricity becomes a problem, a translucent conductive film 40 may be formed on the surface of the spherical portion 2*a* at the front surface side of the face glass 2A, and the translucent conductive film 40 may be connected to the ground potential, as shown in FIG. 4, thereby preventing electrification. In this case, as the translucent conductive film 40, for example, a transparent conductive film made of, e.g., indium oxide, tin oxide, or antimony trioxide; a thin metal film; and a metal particle paste having a high light transmittance can be used. This member is not limited to one having the shape of a film, but a thin film made of, e.g., a metal mesh, a conductive rubber, and the like can be appropriately used, as a matter of course.

Figure 5:
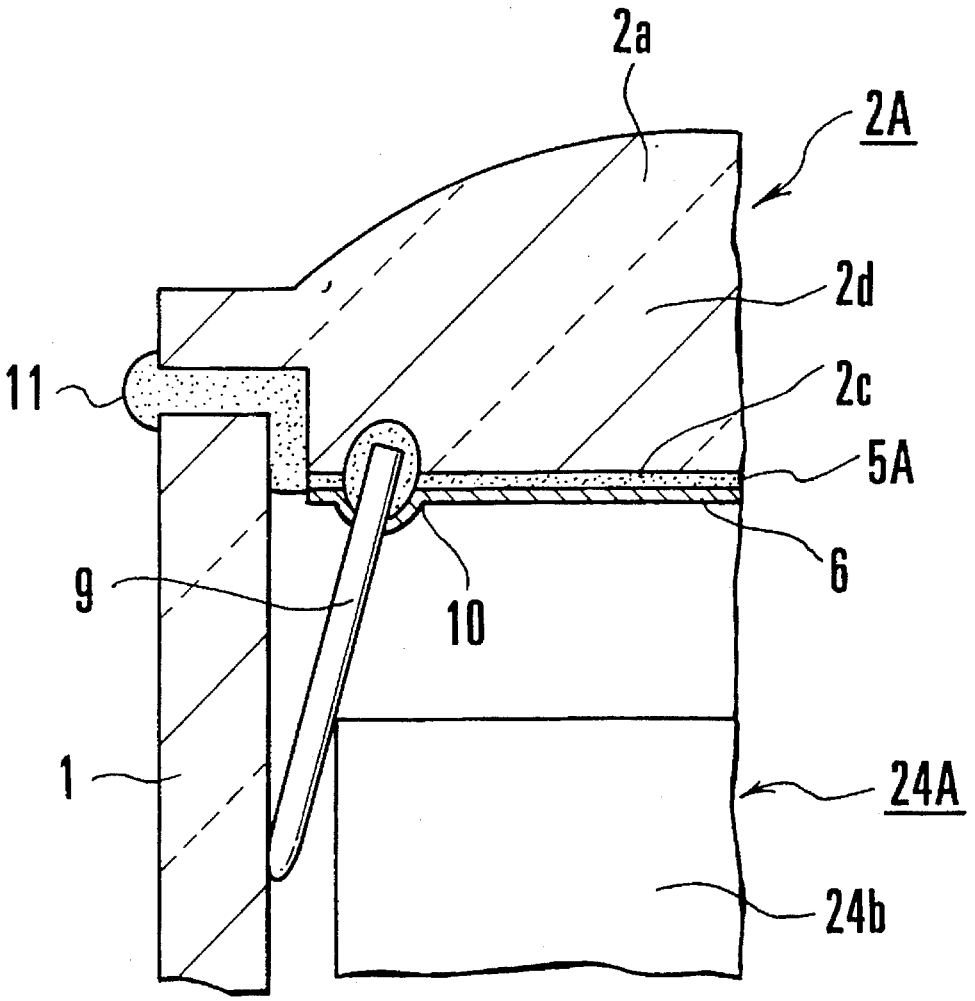
FIG. 5 is an enlarged sectional view of the main part of a fluorescent display tube according to still another embodiment of the present invention.

In the above embodiment, the Al metallized film 6 is formed in the recessed portion 2*d* formed in the inner surface 2*c* of the face glass 2A, one end side of the contact segment 9 is inserted in the recessed portion 2*d* in which the Al metallized film 6 is formed, and this one end side is adhered with the conductive adhering material 10, thereby obtaining electrical contact. However, as shown in FIG. 5, even if one end side of the contact segment 9 is inserted in the recessed portion 2*d* and adhered with the conductive adhering material 10, and the Al metallized film 6 is formed on the conductive adhering material 10 to make electrical connection between the contact segment 9 and the Al metallized film 6, the same effect as that described above can be obtained.

In the above embodiment, the anode electrode assembly 24A disposed in the glass bulb 1 is constituted by the annular anode 24*a* and the cylindrical anode 24*b* obtained by applying a stainless steel thin plate on the outer circumferential surface of the annular anode 24*a* and fixing it by welding at the points $D_1$ and $D_2$. However, the present invention is not limited to this. Assume that a stainless steel thin plate is rolled and inserted in a glass bulb 1 in a temporarily rolled state to form a cylindrical anode electrode assembly. When the roll is inserted in the glass bulb 1, it is brought into tight contact with the inner wall surface of the glass bulb 1 by its elasticity, and arranged at a predetermined position. The other end side of a contact segment 9, one end side of which is connected to an Al metallized film 6, is brought into contact with the inner surface side of an annular anode 24*a* of this cylindrical anode electrode assembly, thereby achieving electrical contact. Even with this arrangement, the same effect as that described above can be obtained.

As has been described above, according to the present invention, since the spherical portion is formed on the front surface side of the face glass assembly, the angle of light emission is increased to greatly increase the angle of visual field. Thus, the display surface can be visually recognized in a wide range.

Since the stepped portion is provided at the peripheral portion of the face glass assembly, the adhesion area is increased. Thus, the adhesion strength is largely increased to reliably prevent cracking and separation. As a result, the quality and reliability can be greatly improved.

The recessed portion is formed in the inner surface of the face glass assembly. The conductive adhering material to be electrically connected to the metallized film is accommodated in the recessed portion, and the contact segment to be electrically connected to the anode electrode with the conductive adhering material is fixed. The other end side of the contact segment is brought into electrical contact with the anode electrode disposed on the glass bulb. Then, electrical contact with the anode electrode becomes reliable, and a gettered film, which is conventionally a factor that makes electrical contact unstable, becomes unnecessary, thereby obtaining stable and reliable conductivity between the metallized film and the anode electrode which does not change over time. As a result, stable electrical contact can be obtained over a long period of time, thereby greatly improving the quality and reliability.

Since the mesh portion spherically projecting toward the phosphor screen is provided at an electron-emitting portion of the grid housing of the cathode assembly, the scattering angle of the electron beams from the filament cathode is increased. Thus, emission spots on the phosphor screen, defective light emission, and the like can be reliably prevented. Also, high-precision alignment with the central axis of the cathode assembly becomes unnecessary. As a result, assembly becomes easy, thereby improving productivity.

Frit glass is not used to bond the glass bulb and the stem glass, and glass members are sealed with each other in accordance with the melting scheme using a burner flame. Thus, the bonding strength can be greatly increased, and separation, cracking, and the like in the heat test can be reliably prevented. Even if a high voltage is applied to the high-voltage applying pin, abnormal electric discharge does not occur, thereby greatly improving reliability.

As a result, a display tube for a light source having a high quality and reliability can be obtained with a high productivity, which is a very excellent effect.

What is claimed is:

1. A display tube for a light source, comprising:

a translucent face glass assembly having a front surface side which is formed spherically, a peripheral portion on which a stepped portion is formed, an inner surface side on which a phosphor layer and a metallized film are sequentially formed, and a contact segment having one end electrically connected to said metallized film;

a glass bulb having one open end portion sealed to said stepped portion of said translucent face glass assembly with low-melting frit glass; and a stem assembly including an anode electrode assembly and a cathode assembly, said anode electrode assembly and said cathode assembly being accommodated in said glass bulb, and said contact segment being contacted by said anode electrode assembly, said stem assembly being hermetically sealed to the other open end portion of said glass bulb, wherein a recessed portion is formed in a surface of said face glass assembly on an inner surface side thereof where said phosphor layer and said metallized film are formed, a conductive adhering material to be electrically connected to said metallized film is accommodated in the recessed portion, said one end of said contact segment is fixed in the recessed portion with said conductive adhering material, and another end thereof is brought into electrical contact with said anode electrode assembly.

2. A display tube according to claim 1, wherein said cathode assembly has a housing that covers a filament cathode and which faces towards said phosphor layer, thus forming a grid mesh portion.

* * * * *